US005509782A

United States Patent [19]

Streeter

[11] Patent Number: 5,509,782

[45] Date of Patent: Apr. 23, 1996

[54] BEARING CASE SUPPORT

[75] Inventor: Robert T. Streeter, Canisteo, N.Y.

[73] Assignee: Dresser-Rand Company, Corning, N.Y.

[21] Appl. No.: 397,743

[22] Filed: Mar. 2, 1995

[51] Int. Cl.[6] ..... F01D 25/28

[52] U.S. Cl. ..... 415/213.1; 248/676; 248/901

[58] Field of Search ..... 415/213.1; 248/666, 248/678, 901

[56] References Cited

U.S. PATENT DOCUMENTS

| | | | |
|---|---|---|---|
| 1,491,423 | 4/1924 | Rice | 248/676 |
| 1,678,968 | 7/1928 | Allen | 248/676 |
| 2,777,665 | 1/1957 | Martinson | 415/213.1 |
| 3,860,359 | 1/1975 | De Feo | 415/213.1 |
| 3,937,433 | 2/1976 | Portaleoni | 248/19 |
| 3,947,322 | 3/1976 | Dorner et al. | 248/901 X |
| 4,050,660 | 9/1977 | Eggmann et al. | 248/676 |
| 4,456,426 | 6/1984 | Bellati | 415/213.1 |
| 4,527,761 | 7/1985 | Nassauer | 248/901 |
| 5,078,576 | 1/1992 | Hayton . | |
| 5,108,258 | 4/1992 | Gros | 415/213.1 |
| 5,273,249 | 12/1993 | Peterson et al. . | |
| 5,447,025 | 9/1995 | Rousselle | 415/213.1 |

FOREIGN PATENT DOCUMENTS

| | | | |
|---|---|---|---|
| 54-118949 | 9/1979 | Japan | 248/901 X |

*Primary Examiner*—Edward K. Look

*Assistant Examiner*—Michael S. Lee

*Attorney, Agent, or Firm*—Richards, Medlock & Andrews

[57] ABSTRACT

A first end of a turbine casing is rigidly supported by a support member, while the second end is supported via a bearing case. The inboard end of the bearing case supports the second end of the turbine casing at points in a horizontal plane containing the longitudinal axis of the turbine shaft. The inboard end of the bearing case is supported by at least one inboard support element, while the outboard end of the bearing case is supported by at least one outboard support element. Each of the inboard support element and the outboard support element provides vertical support while permitting movement of the bearing case in a direction parallel to the longitudinal axis of the turbine shaft. The outboard support element has upper and lower camming shim members with mating inclined surfaces. Each of the inclined surfaces can be a planar surface which is inclined at an acute angle to a horizontal plane and which intersects the horizontal plane along a line perpendicular to a vertical plane containing the longitudinal axis of the turbine shaft. The lower camming shim member can be stationarily mounted, while the upper camming shim member can be connected to the bearing case by at least one elongated member which extends outwardly from the bearing case in a direction at least generally parallel to the longitudinal axis of the turbine shaft. The outboard support element maintains the alignment of the bearing case with the turbine shaft during operation of the turbine at elevated temperatures.

23 Claims, 4 Drawing Sheets

BEARING CASE SUPPORT

FIELD OF THE INVENTION

This invention relates to an apparatus for supporting a bearing case. In a particular aspect, the invention relates to an apparatus for supporting the bearing case of a turbine so that the orientation of the bearing case with respect to the turbine shaft does not change despite temperature changes occurring during operation of the turbine.

BACKGROUND OF THE INVENTION

Turbines which are utilized with hot fluids experience dimensional changes during the operation of the turbine as a result of substantial temperature changes in the components of the turbine. For example, during operation, portions of a steam turbine can reach temperatures which are sufficiently elevated that the elongated components, such as the turbine shaft and the turbine case, experience substantial increases in their length, which must be taken into account in designing the mechanical support for the turbine. One technique has been to provide a bearing case at one end of the turbine shaft, with the bearing case being mounted on flexible supports, while the other end of the turbine shaft is mounted on fixed supports. In one such system, each of the four corners of the bearing case is mounted on a flex plate support having one or more vertical plates which provide vertical support, but which flex relatively easily in a direction parallel to the longitudinal axis of the turbine shaft. However, the inboard end of the bearing case, i.e., adjacent to the turbine casing, experiences operating temperatures which are substantially higher than the operating temperatures of the outboard end of the bearing case, i.e., remote from the turbine casing. This difference in operating temperatures results in the two flex plate supports at the inboard end of the bearing case experiencing greater thermal expansion than the two flex plate supports at the outboard end of the bearing case, such that the elevation of the inboard end of the bearing case becomes higher than the elevation of the outboard end of the bearing case, resulting in a deviation in the orientation of the bearing case with respect to the longitudinal axis of the turbine shaft. This deviation in orientation can cause severe damage to the bearings as well as to other parts which become misaligned with the turbine shaft as a result of the deviation.

Accordingly, there is a need for providing for axial expansion of a turbine machine during operation while avoiding deviations in the orientation of the turbine shaft with respect to the support bearings for the turbine shaft, and to other components positioned by the bearing case.

SUMMARY OF THE INVENTION

The present invention provides apparatus for supporting a bearing case for a turbine shaft. One end of the bearing case supports the steam inlet end of the turbine casing and is supported by at least one inboard support element, while the other end of the bearing case is supported by at least one outboard support element. Each support element provides vertical support for the bearing case while permitting movement of the bearing case in a direction at least substantially parallel to the longitudinal axis of the turbine shaft. The outboard support element has upper and lower camming shim members with mating inclined surfaces. Each inclined surface can be a planar surface which is inclined at an acute angle to a horizontal plane and which intersects the horizontal plane along a line perpendicular to a vertical plane containing the longitudinal axis of the turbine shaft. Thus, the outboard support element maintains the alignment of the bearing case with the turbine shaft during operation of the turbine at elevated temperatures.

In a presently preferred embodiment, the lower camming shim member is stationarily mounted, while the upper camming shim member is connected to the bearing case via at least one elongated member which extends outwardly from the bearing case in a direction at least generally parallel to the longitudinal axis of the turbine shaft, thereby increasing the distance, parallel to the longitudinal axis of the turbine shaft, between the inboard support element and the outboard support element and thus reducing the magnitude of the angle of deviation of the axis of the bearing case from the longitudinal axis of the turbine shaft which would otherwise result from any difference in the thermal expansion of the inboard support element and the corresponding change in the vertical height of the outboard support element.

DETAILED DESCRIPTION

Figure 1:
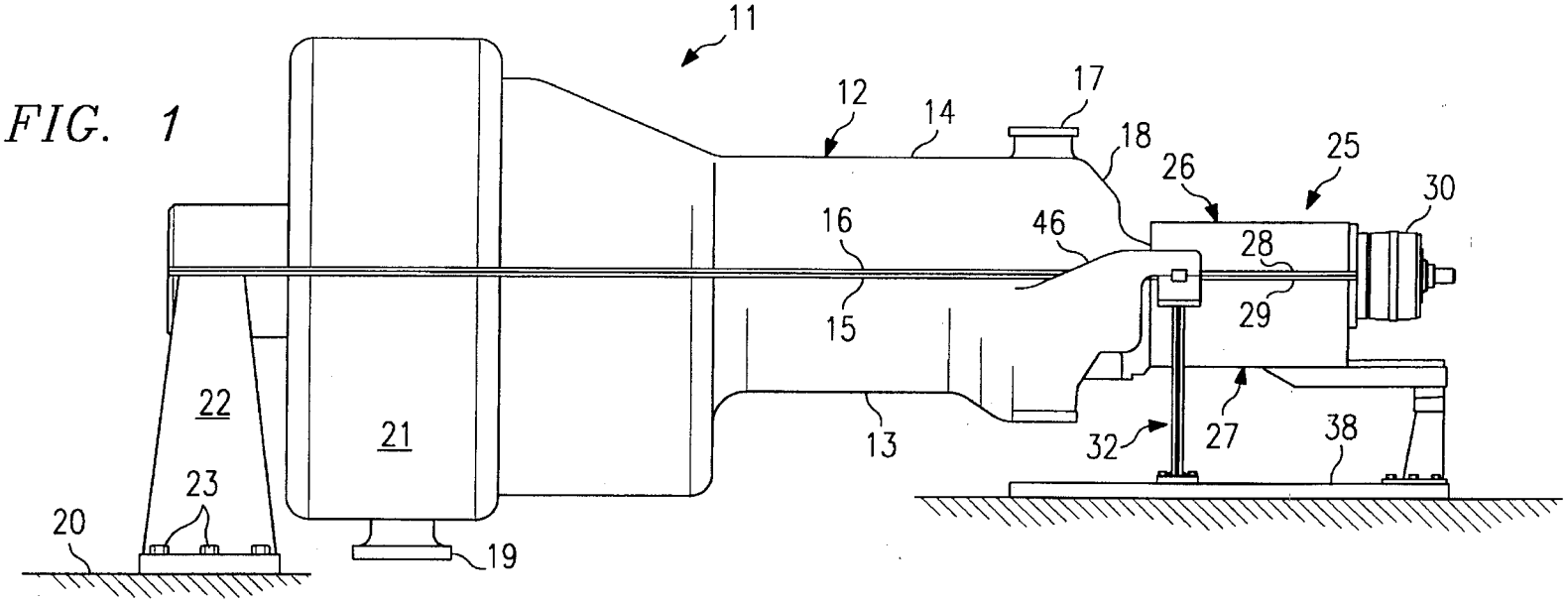
FIG. 1 Is a side elevation view of a turbine casing and bearing case.

A presently preferred embodiment of a bearing case support in accordance with the present invention is illustrated in the drawings in an environment of a steam turbine 11 with a turbine casing 12 having a lower half casing 13 and an upper half casing 14 joined together along their mating laterally extending flanges 15 and 16 to enclose the turbine shaft 10 and the other internal turbine components (not shown). A high pressure steam inlet 17 is provided in the first or high pressure inlet end portion 18 of the casing 12, while a low pressure exhaust steam outlet 19 is provided in the second or low pressure exhaust end portion 21 of the casing 12. The exhaust end portion 21 of the lower half casing 13 is rigidly supported by a pair of vertical supports 22 located on opposite sides of the lower half casing 13 and bolted to the foundation 20 by bolts 23. The inlet end portion 18 of the casing 12 is flexibly supported via a bearing case 25 so that any increase in the length of the turbine casing 12 along the longitudinal axis of the turbine shaft 10 is accommodated by the flexibly supported bearing case 25.

The bearing case 25 has an upper half case 26 and a lower half case 27 joined together along their mating laterally extending flanges 28 and 29 to enclose suitable journal bearing 73 and thrust bearings 75 and 76 for the turbine shaft 10 as well as at least substantially enclosing an end portion of the turbine shaft 10. A turning gear mechanism 30 can be mounted on the end of the bearing case 25 remote from the turbine casing 12. The turning gear mechanism 30 can be utilized to engage the turbine shaft 10 for rotation of the turbine shaft 10 at a low rate during startup operations and also during cool down operations after the turbine components have been heated to elevated operating temperatures, in order to avoid distortions in the turbine shaft and the other rotary components.

Figure 2:
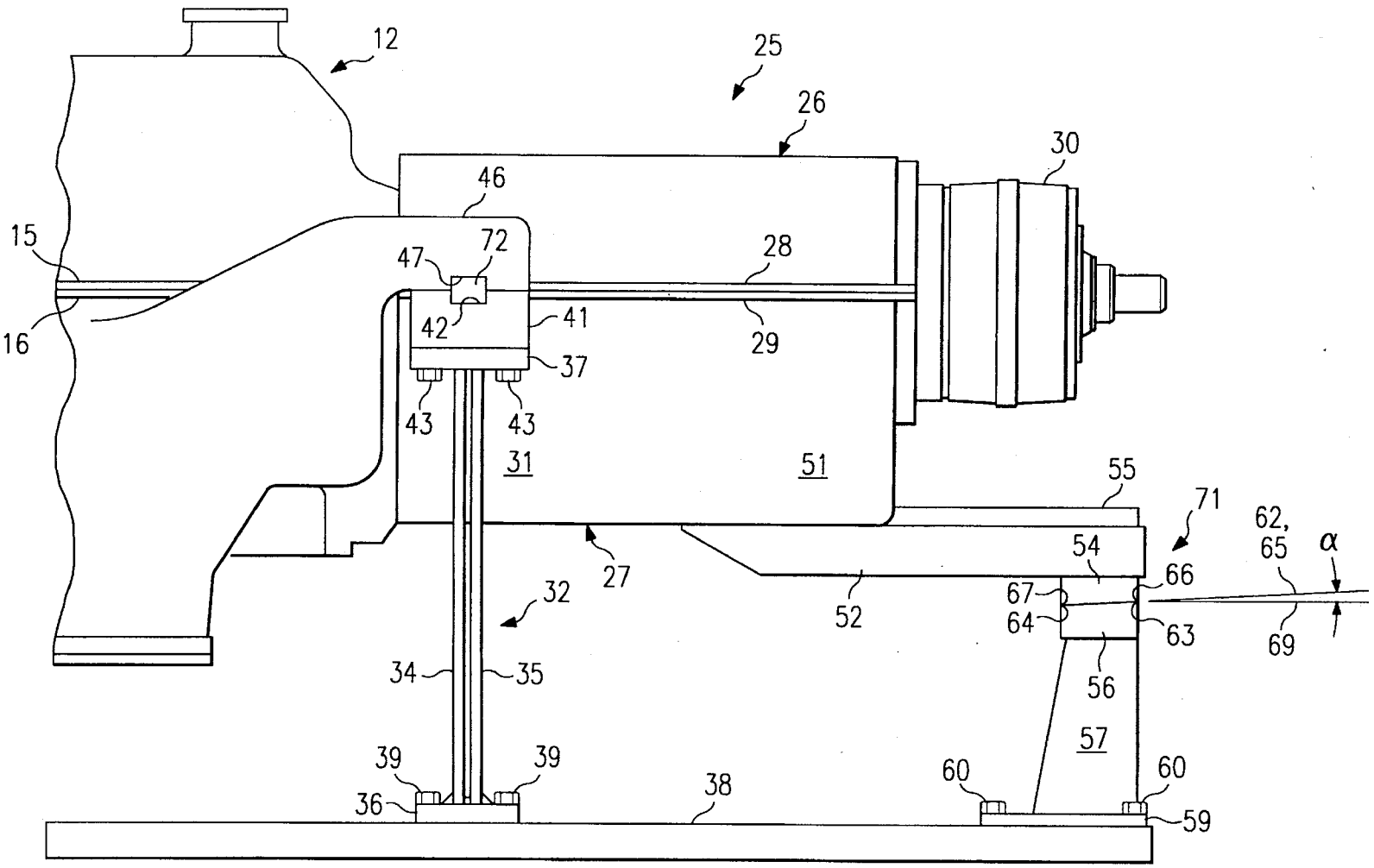
FIG. 2 is an enlarged side elevation view of the bearing case and its supports.
Figure 3:
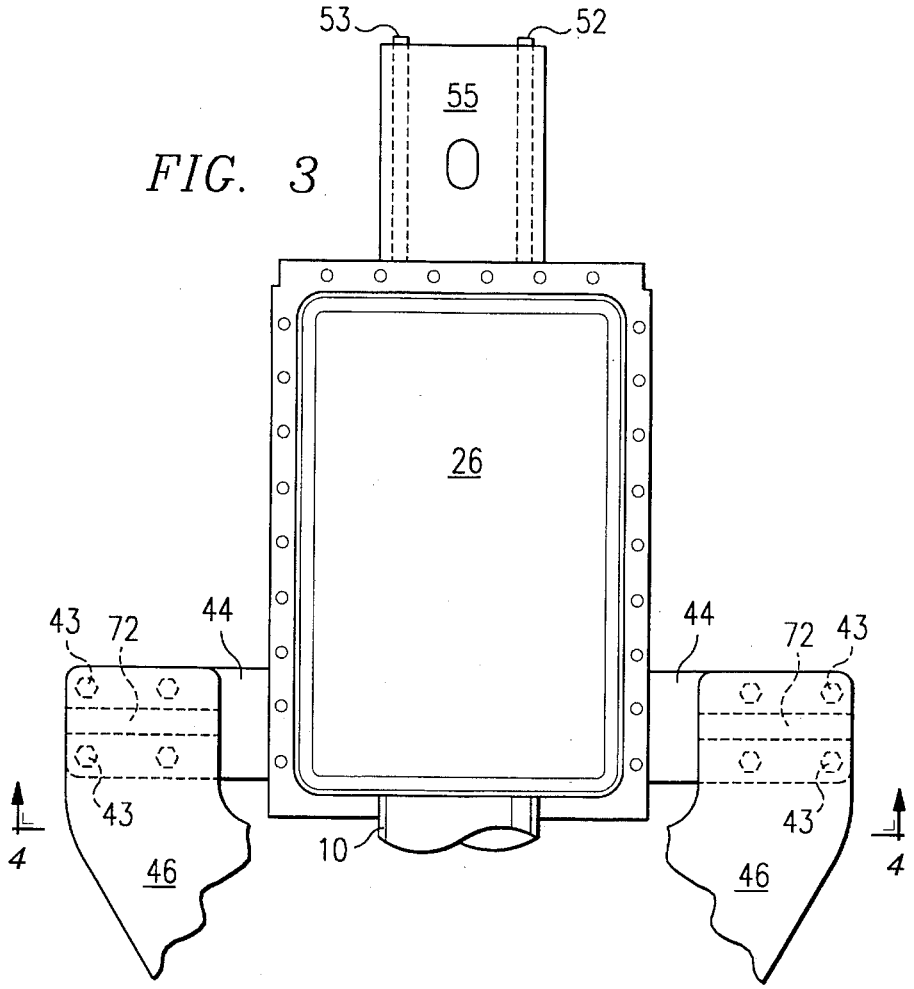
FIG. 3 is a plan view of the bearing case of FIG. 2 with the turning gear mechanism omitted for clarification.
Figure 4:
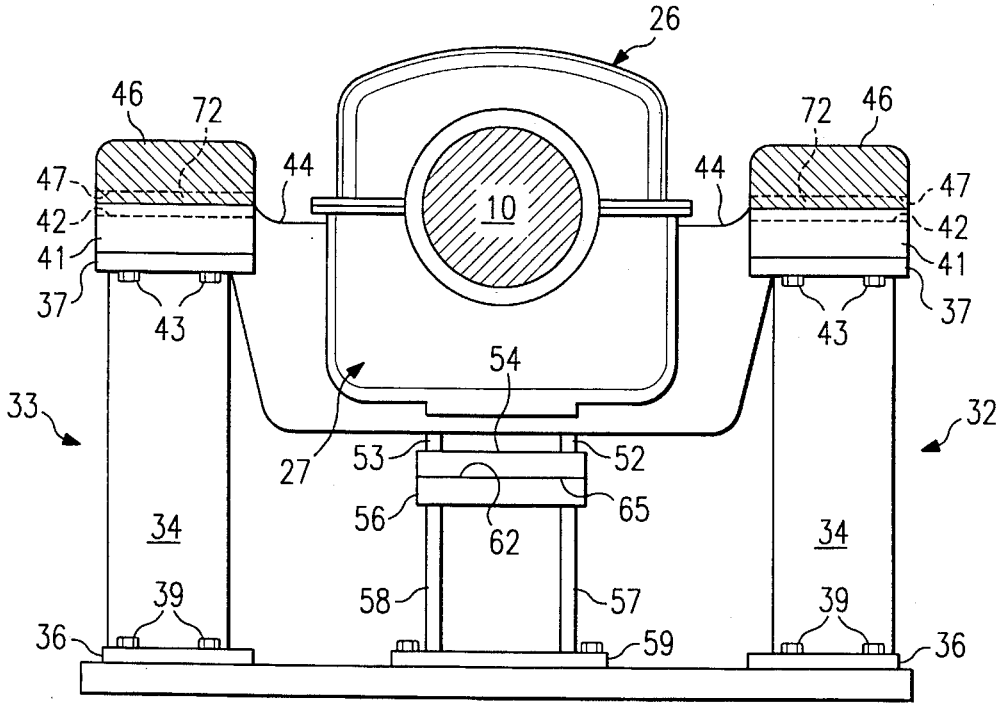
FIG. 4 is an inboard end elevation view of the bearing case of FIG. 2.
Figure 5:
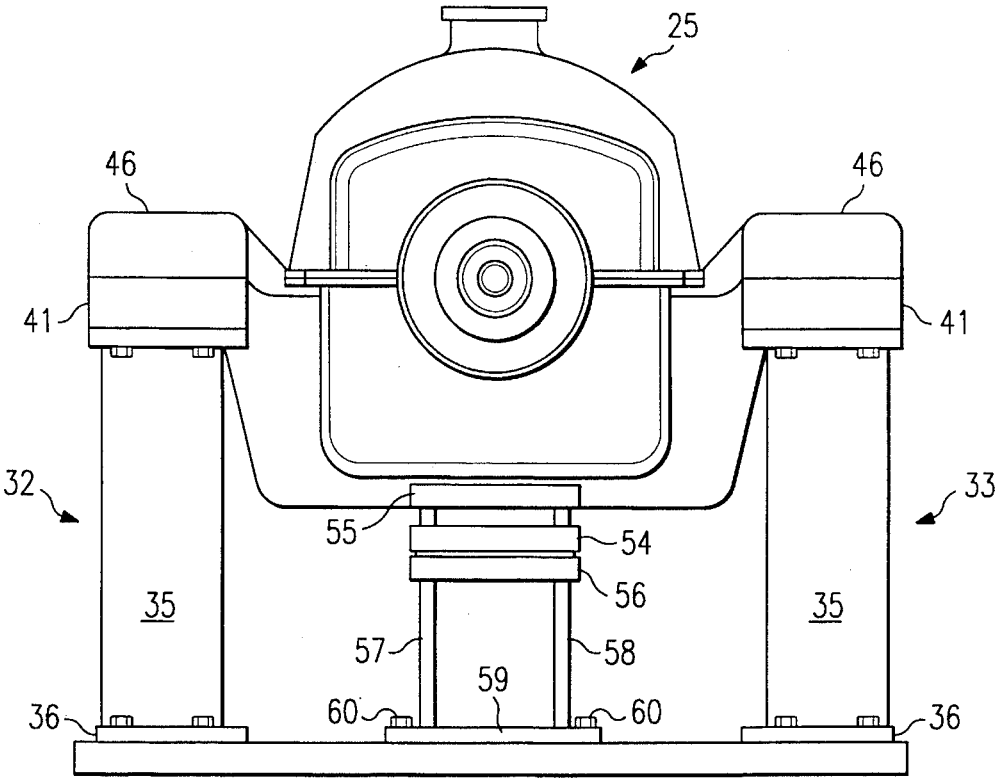
FIG. 5 is an outboard end elevation view of the bearing case of FIG. 2.

As shown in FIGS. 2–5, the inboard end portion 31, which is the end portion of the bearing case 25 closest to the turbine casing 12, is mounted on a pair of flex plate supports 32 and 33. As shown in FIGS. 2–4, each of the flex plate supports 32 and 33 comprises two vertically extending plates 34 and 35 having their lower ends secured to a first mounting plate 36 and their upper ends secured to a second mounting plate 37. The mounting plate 36 is bolted to the foundation 38 by bolts 39. Two lugs 41 extend horizontally outwardly from opposite sides of the lower half bearing case 27, with each lug 41 being positioned on the top surface of a respective upper mounting plate 37. The upper surfaces of the lugs 41 are in a horizontal plane which also contains the longitudinal axis of shaft 10. Each lug 41 has a keyway 42 formed in its upper surface, with the keyway 42 extending radially outwardly from the longitudinal axis of shaft 10. Each upper mounting plate 37 is securely bolted to the respective lug 41 by bolts 43. Each lug 41 represents the distal end of a support arm 44 which is part of the lower half bearing case 27. A pair of arms 46 extends outwardly from the inlet end of the lower half 13 of the turbine casing 12 parallel to the longitudinal axis of shaft 10 so as to rest on the lugs 42. A keyway 47 is formed in the lower surface of each of the arms 46 so that a key 72 is received within the mating keyways 42 and 47. The key 72 maintains the alignment of the lug 41 and the arm 46 in a direction parallel to the longitudinal axis of the turbine shaft 10, while permitting relative movement between the arm 46 and the lug 41 in a direction radial to the longitudinal axis of the turbine shaft 10. Thus, the inlet end portion 18 of the turbine casing 12 is supported at the machine centerline, i.e., the horizontal plane containing the longitudinal axis of shaft 10. This centerline support of the turbine casing 12 means that the centerline of the turbine casing 12 will remain coincident with the centerline of the shaft 10 as temperature changes occur. As any alteration of the relationship between the turbine case 12 and the shaft 10 is avoided, there is no need for laterally or radially sloped surfaces to movably support the turbine casing 12.

Each of the plates 34 and 35 is positioned with its width being perpendicular to the longitudinal axis of the turbine shaft 10, while the thickness of each of the plates 34 and 35, which extends parallel to the longitudinal axis of the turbine shaft 10, is substantially smaller than the width of each of the plates 34 and 35. The plates 34 and 35 have enough strength to provide vertical support of the bearing case 25 and the high pressure end 18 of the turbine casing 12, but the thickness of each of the plates 34 and 35 is such that the plates 34 and 35 will flex relatively readily in a direction parallel with the longitudinal axis of the turbine shaft 10, so that changes in the length of the turbine casing 12, resulting from the exposure thereof to hot fluid, are readily accommodated by such flexing of the plates 34 and 35. While each flex plate support 32 and 33 is illustrated as being formed of two flex plates 34 and 35, each flex plate support 32 and 33 can be formed of a single flex plate or of three or more flex plates. Any suitable means, e.g., welding, can be employed to secure the ends of the flex plates 34 and 35 to the lower mounting plate 36 and to the upper mounting plate 37.

Figure 6:
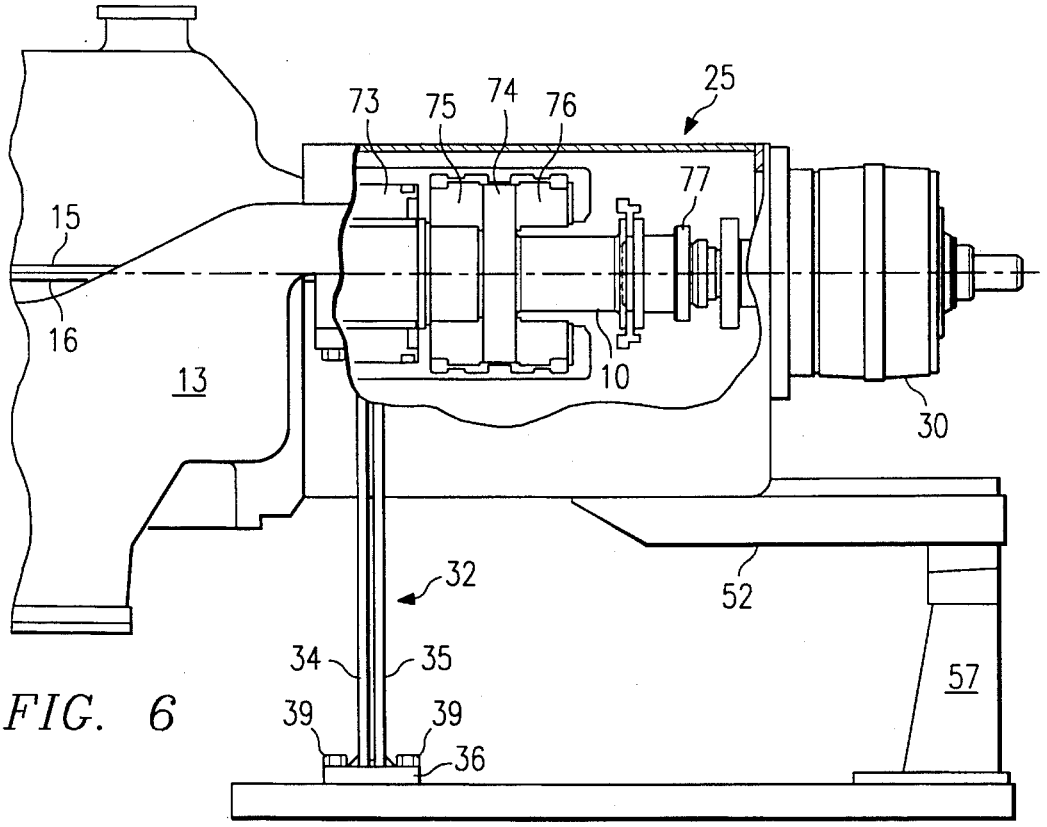
FIG. 6 is a cross-sectional view of the bearing case along a vertical plane containing the shaft axis.

As shown in FIG. 6, the bearing case 25 contains an annular journal bearing 73, e.g., a tilt pad bearing, a sleeve bearing, etc., which surrounds and is concentric to the turbine shaft 10 to provide radial bearing support for the shaft 10. A thrust collar 74 extends radially outwardly from shaft 10 and is positioned between annular thrust bearings 75 and 76, also located in the bearing case 25. The thrust collar 74 moves with the bearing case 25 as the turbine shaft 10 grows/shrinks longitudinally due to temperature changes. A clutch 77 is positioned so as to engage/disengage the end of turbine shaft 10 with the turning gear mechanism 30.

As shown in FIGS. 2–5, the outboard end portion 51, which is the end portion of the bearing case 25 remote from the turbine casing 12, has a pair of elongated structural members 52 and 53 extending at least generally horizontally outwardly from the lower half bearing case 27 in a direction parallel to the longitudinal axis of the turbine shaft 10. An upper camming shim member 54 is mounted on the underside of the distal ends of elongated members 52 and 53 so as to extend perpendicularly to the vertical plane containing the longitudinal axis of the turbine shaft 10. A plate 55 is mounted on the top surfaces of elongated members 52 and 53 to maintain the spacing between elongated members 52 and 53 and to provide a rigid support structure. A lower camming shim member 56 is stationarily mounted on the upper ends of two vertical plate members 57 and 58 such that the lower camming shim member 56 extends perpendicularly to the vertical plane containing the longitudinal axis of the turbine shaft 10. The lower ends of the two vertical plate members 57 and 58 are secured to a mounting plate 59, which is secured to foundation 38 by bolts 60.

The lower camming shim member 56 has an upper camming surface 62 which is a planar surface and which is inclined with respect to a horizontal plane so that the intersection of the planar surface 62 and the horizontal plane is a line which is perpendicular to the vertical plane containing the longitudinal axis of the turbine shaft 10. Thus, the planar surface 62 provides an upper edge 63 and a lower edge 64, the upper edge 63 being more remote from the inboard end portion 31 of the bearing case 25 than the lower edge 64.

The upper camming shim member 54 has a lower camming surface 65 which is a planar surface and which is inclined with respect to a horizontal plane so that the intersection of the planar surface 65 and the horizontal plane is also a line which is perpendicular to the vertical plane containing the longitudinal axis of the turbine shaft 10. Thus, the planar surface 65 provides an upper edge 66 and a lower edge 67, the upper edge 66 being more remote from the inboard end portion 31 of the bearing case 25 than the lower edge 67.

The upper camming shim member 54 is mounted above the lower camming shim member 56 with the lower camming surface 65 of the upper camming shim member 54 being in mating contact with the upper camming surface 62 of the lower camming shim member 56. In other words, the lower camming surface 65 of the upper camming shim member 54 is in sliding contact with the upper camming surface 62 of the lower camming shim member 56. As shown in FIG. 2, each of the surfaces 62 and 65 is inclined at an acute angle $\alpha$ with respect to the horizontal plane 69. Thus, the upper camming shim member 54 and the lower camming shim member 56 collectively form a variable height outboard support element 71 which permits variations in the vertical and horizontal positions of the upper camming shim member 54. While two or more outboard support elements 71 could be employed, it is presently preferred that the outboard support element 71 be positioned at least substantially symmetrically with respect to a vertical plane containing the longitudinal axis of the turbine shaft 10.

Figure 7:
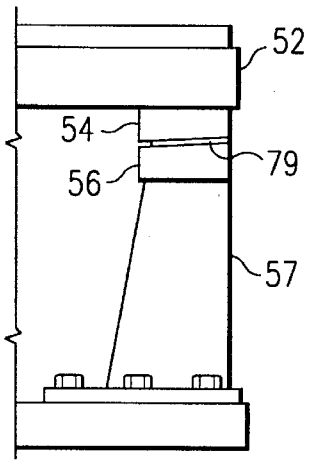
FIG. 7 is a side elevation view of a modification of the outboard support element.

A modified outboard support element is illustrated in FIG. 7, wherein the upper camming surface for the lower camming shim member is formed by a wear plate 79 which is removably secured to the inclined surface of the lower shim member 56. If desired, the wear plate 79 could be secured to the lower inclined surface of the upper shim member 54 instead of to the lower shim member 56. Also, two wear plates could be provided, with each being secured to a respective one of the upper shim member 54 and the lower shim member 56. In any case, the formation of the wear plate 79 with its upper and lower surfaces being parallel simplifies the manufacture and cost of the wear plate 79, so that it can serve as a readily replaceable, inexpensive wearing surface for the outboard support element 71.

During operation of the turbine 11, the temperature of the inboard end portion 31 of the bearing case 25 becomes higher than the temperature of the outboard end portion 51 of the bearing case 25. This results in the temperature of the flex plate supports 32 and 33 becoming greater than the temperature of the outboard support element 71. The increase in the temperature of the flex plate supports 32 and 33 results in an increase in the vertical length of these flex plate supports 32 and 33 and thus an increase in the vertical height of the inboard end portion 31 of the bearing case 25, as represented by the vertical position of the lugs 41. Although the lower operating temperatures of the outboard support element 71 do result in an increase in the vertical length of the plates 57 and 58, such increase is generally substantially less than the increase in the vertical length of the flex plates 34 and 35. However, the operating temperatures of the turbine 11 also result in an increase in the length of the turbine shaft 10 and the length of the turbine casing 12 in a direction parallel to the longitudinal axis of the turbine shaft 10. As the low pressure end portion 21 of the turbine casing 12 is mounted on supports 22 which prevent axial movement of the low pressure end portion 21, any increase in axial length of the turbine casing 12 appears at the inboard end portion 31 of the bearing case 25. This causes the flex plates 34 and 35 to flex to the right, as viewed in FIG. 2, thereby causing the bearing case 25 and the support members 52 and 53 to also move to the right. The rightward movement of the support members 52 and 53 causes the upper camming shim member 54 to move to the right and upwardly as a result of the inclined nature of the upper surface 62 of the lower camming shim member 56 and the fact that movement of the lower camming shim member 56 is prevented by the mounting plate 59 being bolted to the foundation 38. The increase in the vertical position of the upper camming shim member 54 as a result of its movement up the inclined plane 62, plus any increase in the vertical position of the upper camming shim member 54 as a result of thermal expansion in the vertical direction by the plates 57 and 58 and the camming shim members 54 and 56 is substantially equal to the increase in the vertical position of the lugs 41 resulting from the thermal expansion of the flex plates 34 and 35 in the vertical direction. Thus, during operation of the turbine machine 11 at elevated temperatures, the end portion of the turbine shaft 10 enclosed by the bearing case 25 can be maintained in alignment with the centerline of the bearing case 25.

During a cool down operation of the turbine 11 following an operation at elevated temperatures, the temperature of the inboard end portion 31 of the bearing case 25 decreases, resulting in a corresponding decrease in the temperature of the flex plate supports 32 and 33, thereby resulting in a decrease in the vertical height of the inboard end portion of the bearing case 25 as represented by the lugs 41. While this decrease in vertical height of the inboard end portion 31 is greater than any decrease in the vertical height of the outboard end portion 51 of the bearing case 25 due to thermal contraction of the outboard support element 71, there is a corresponding decrease in the axial length of the turbine casing 12, resulting in the leftward and downward movement, as viewed in FIG. 2, of the upper camming shim member 54. Thus, the combination of the decrease in the vertical height of the outboard end portion 51 of the bearing case 25 due to thermal contraction of the outboard support element 71, and the downward movement of the upper camming shim member 54 along the inclined surface 62 is substantially equal to the decrease in vertical position of the inboard end portion 31 of the bearing case 25. Accordingly, during a cool down operation, the end portion of the turbine shaft 10 enclosed by the bearing case 25 can be maintained in alignment with the centerline of the bearing case 25.

From the foregoing, it is apparent that the outboard support element 71 provides vertical support for the outboard end portion 51 of the bearing case 25 while permitting movement of the outboard end portion 51 in a direction at least substantially parallel to the longitudinal axis of the turbine shaft 10. This enables the centerline of the bearing case 25 to be maintained level, as viewed from the side, and in alignment with the centerline of the turbine shaft 10, even if the inboard end portion 31 of the bearing case 25 or the inboard support elements 32 and 33 become hotter than the outboard end portion 51 of the bearing case 25 and the outboard support element 71.

The use of the elongated structural members 52 and 53 extending outwardly from the bearing case 25 in a direction at least generally parallel to the longitudinal axis of the turbine shaft 10 increasing the distance, parallel to the longitudinal axis of the turbine shaft 10, between the inboard support elements 32 and 33 and the outboard support element 71, reduces the magnitude of the angle of any deviation of the axis of the bearing case 25 from the longitudinal axis of the turbine shaft 10 which would otherwise result from any difference in the thermal expansion of the inboard support elements 32 and 33 and the corresponding change in the vertical height of the outboard support element 71. Such difference in vertical heights can be the result of variations in temperatures of various components during operation, e.g., resulting from air drafts having different cooling effects on different components at different times, or resulting from the ratio of vertical change to horizontal change of the inclined plane 62 differing from the ratio of vertical thermal expansion changes to axial thermal expansion changes. Thus, should such differences occur, the outward positioning of the outboard support element 71 reduces the effect of such differences.

Reasonable variations and modifications are possible within the scope of the foregoing description, the drawings and the appended claims to the invention. For example, while the camming shim surfaces 62 and 65 have been illustrated as planar surfaces, they can be of any suitable configuration which permits vertical movement of the upper camming shim member 54 as a result of horizontal movement of the upper camming shim member along a line parallel to the longitudinal axis of turbine shaft 10. The use of parabolic surfaces which are symmetrical to a vertical plane parallel to the vertical plane containing the longitudinal axis of the turbine shaft 10 while having the parabolic axis inclined to a horizontal plane would permit the desired relationship of vertical movement of the upper camming shim member 54 as a result of horizontal movement of the upper camming shim member along a line parallel to the longitudinal axis of turbine shaft 10 while preventing lateral movement of the upper camming shim member 54 in a direction perpendicular to the vertical plane containing the longitudinal axis of the turbine shaft 10. While the inboard support elements have been illustrated as flex plate supports, any other known support element, suitable for permitting axial movement of the bearing case, can be employed.

That which is claimed is:

1. Apparatus, suitable for use with a turbine machine having a turbine casing enclosing a turbine shaft, for supporting an end portion of said turbine shaft and an end of said turbine casing, said apparatus comprising:

a bearing case for at least substantially enclosing said end portion of said turbine shaft, said bearing case having an inboard end portion adjacent to said turbine casing and an outboard end portion remote from said turbine casing;

at least one inboard support element connected to said inboard end portion of said bearing case to provide vertical support for said inboard end portion of said bearing case while permitting movement of said inboard end portion of said bearing case in a direction at least substantially parallel to the longitudinal axis of said turbine shaft; and at least one outboard support element connected to said outboard end portion of said bearing case to provide vertical support for said outboard end portion of said bearing case while permitting movement of said outboard end portion of said bearing case in a direction at least substantially parallel to the longitudinal axis of said turbine shaft, each said outboard support element having upper and lower camming shim members, each said upper camming shim member being mounted to said outboard end portion of said bearing case, each said lower camming shim member being stationarily mounted, an upper surface of said lower camming shim member being inclined with respect to a horizontal plane so as to provide an upper edge and a lower edge of said upper surface of said lower camming shim member, such that said upper edge of said upper surface of said lower camming shim member is more remote from said inboard end portion than said lower edge of said upper surface of said lower camming shim member, a lower surface of said upper camming shim member being inclined with respect to said horizontal plane so as to provide an upper edge and a lower edge of said lower surface of said upper camming shim member, such that said upper edge of said lower surface of said upper camming shim member is more remote from said inboard end portion than said lower edge of said lower surface of said upper camming shim member, said upper camming shim member being positioned above said lower camming shim member with said lower surface of said upper camming shim member being in sliding contact with said upper surface of said lower camming shim member, whereby said outboard end portion of said bearing case can be maintained in alignment with said end portion of said turbine shaft during operation of said turbine machine at elevated temperatures.

2. Apparatus in accordance with claim 1, wherein said at least one outboard support element is positioned at least substantially symmetrically with respect to a vertical plane containing the longitudinal axis of said turbine shaft.

3. Apparatus in accordance with claim 2, wherein there are at least two inboard support elements connected to said inboard end portion of said bearing case to provide vertical support for said inboard end portion of said bearing case.

4. Apparatus in accordance with claim 3, wherein each of said inboard support elements comprises a plurality of vertically extending elongated flex plates, each of said flex plates being positioned with its width perpendicular to said longitudinal axis of said turbine shaft.

5. Apparatus in accordance with claim 4, wherein each of said lower surface of said upper camming shim element and said upper surface of said lower camming shim element is an at least substantially planar surface, with each planar surface being inclined at an acute angle to a horizontal plane containing the longitudinal axis of said turbine shaft, with an intersection of each planar surface with said horizontal plane being a line which is perpendicular to a vertical plane containing said longitudinal axis.

6. Apparatus in accordance with claim 5, wherein said at least one outboard support element is connected to said outboard end portion of said bearing case by at least one structural element which extends at least generally parallel to said longitudinal axis of said turbine shaft outwardly from said outboard end portion so as to increase the distance between said at least one inboard support element and said at least one outboard support element.

7. Apparatus in accordance with claim 1, wherein there are at least two inboard support elements connected to said inboard end portion of said bearing case to provide vertical support for said inboard end portion of said bearing case.

8. Apparatus in accordance with claim 1, wherein each of said inboard support elements comprises a plurality of vertically extending elongated flex plates, each of said flex plates being positioned with its width perpendicular to said longitudinal axis of said turbine shaft.

9. Apparatus in accordance with claim 1, wherein each of said lower surface of said upper camming shim element and said upper surface of said lower camming shim element is an at least substantially planar surface, with each planar surface being inclined at an acute angle to a horizontal plane containing the longitudinal axis of said turbine shaft, with an intersection of each planar surface with said horizontal plane being a line which is perpendicular to a vertical plane containing said longitudinal axis.

10. Apparatus in accordance with claim 1, wherein said at least one outboard support element is connected to said outboard end portion of said bearing case by at least one structural element which extends at least generally parallel to said longitudinal axis of said turbine shaft outwardly from said outboard end portion so as to increase the distance between said at least one inboard support element and said at least one outboard support element.

11. Apparatus comprising:

a turbine machine having a turbine casing enclosing a turbine shaft, said turbine shaft having a longitudinal axis, said turbine casing having a first end portion and a second end portion, at least one turbine casing support element connected to said first end portion of said turbine casing to provide vertical support for said turbine casing;

a bearing case at least substantially enclosing an end portion of said turbine shaft, said bearing case having an inboard end portion for supporting an end portion of said turbine shaft and said second end portion of said turbine casing, said bearing case having an outboard end portion remote from said turbine casing;

at least one inboard support element connected to said inboard end portion of said bearing case to provide vertical support for said inboard end portion of said bearing case while permitting movement of said inboard end portion of said bearing case in a direction at least substantially parallel to the longitudinal axis of said turbine shaft; and at least one outboard support element connected to said outboard end portion of said bearing case to provide vertical support for said outboard end portion of said bearing case while permitting movement of said outboard end portion of said bearing case in a direction at least substantially parallel to the longitudinal axis of said turbine shaft, each said outboard support element having upper and lower camming shim members, each said upper camming shim member being mounted to said outboard end portion of said bearing case, each said lower camming shim member being stationarily mounted, an upper surface of each said lower camming shim member being inclined with respect to a horizontal plane so as to provide an upper edge and a lower edge of said upper surface of said lower camming shim member, such that said upper edge of said upper surface of said lower camming shim member is more remote from said inboard end portion than said lower edge of said upper surface of said lower camming shim member, a lower surface of each said upper camming shim member being inclined with respect to said horizontal plane so as to provide an upper edge and a lower edge of said lower surface of said upper camming shim member, such that said upper edge of said lower surface of said upper camming shim member is more remote from said inboard end portion than said lower edge of said lower surface of said upper camming shim member, said upper camming shim member being positioned above said lower camming shim member with said lower surface of said upper camming shim member being in sliding contact with said upper surface of said lower camming shim member, whereby said outboard end portion of said bearing case can be maintained in alignment with said end portion of said turbine shaft during operation of said turbine machine at elevated temperatures.

12. Apparatus in accordance with claim 11, wherein said at least one turbine casing support element connected to said first end portion of said turbine casing prevents any movement in a direction parallel to said longitudinal axis of said turbine shaft of the part of said first end portion of said turbine casing to which said at least one turbine casing support element is connected.

13. Apparatus in accordance with claim 11, wherein said at least one outboard support element is positioned at least substantially symmetrically with respect to a vertical plane containing the longitudinal axis of said turbine shaft.

14. Apparatus in accordance with claim. 13, wherein there are at least two inboard support elements connected to said inboard end portion of said bearing case to provide vertical support for said inboard end portion of said bearing case.

15. Apparatus in accordance with claim 14, wherein each of said inboard support elements comprises a plurality of vertically extending elongated flex plates, each of said flex plates being positioned with its width perpendicular to said longitudinal axis of said turbine shaft.

16. Apparatus in accordance with claim 15, wherein each of said lower surface of said upper camming shim element and said upper surface of said lower camming shim element is an at least substantially planar surface, with each planar surface being inclined at an acute angle to a horizontal plane containing the longitudinal axis of said turbine shaft, with an intersection of each planar surface with said horizontal plane being a line which is perpendicular to a vertical plane containing said longitudinal axis.

17. Apparatus in accordance with claim 16, wherein said at least one outboard support element is connected to said outboard end portion of said bearing case by at least one structural element which extends at least generally parallel to said longitudinal axis of said turbine shaft outwardly from said outboard end portion so as to increase the distance between said at least one inboard support element and said at least one outboard support element.

18. Apparatus in accordance with claim 11, wherein there are at least two inboard support elements connected to said inboard end portion of said bearing case to provide vertical support for said inboard end portion of said bearing case.

19. Apparatus in accordance with claim 11, wherein each of said inboard support elements comprises a plurality of vertically extending elongated flex plates, each said flex plate being positioned with its width perpendicular to said longitudinal axis of said turbine shaft.

20. Apparatus in accordance with claim 11, wherein each of said lower surface of said upper camming shim element and said upper surface of said lower camming shim element is an at least substantially planar surface, with each planar surface being inclined at an acute angle to a horizontal plane containing the longitudinal axis of said turbine shaft, with an intersection of each planar surface with said horizontal plane being a line which is perpendicular to a vertical plane containing said longitudinal axis.

21. Apparatus in accordance with claim 11, wherein said at least one outboard support element is connected to said outboard end portion of said bearing case by at least one structural element which extends at least generally parallel to said longitudinal axis of said turbine shaft outwardly from said outboard end portion so as to increase the distance between said at least one inboard support element and said at least one outboard support element.

22. Apparatus in accordance with claim 11, wherein a pair of arms extends outwardly from said second end portion of said turbine casing in a direction at least generally parallel to the longitudinal axis of said turbine shaft, with a lower arm surface of a distal end portion of each of said arms being supported on an upper lug surface of a respective one of a pair of lugs mounted on said bearing case such that each said lug surface is in a plane containing said longitudinal axis of said turbine shaft.

23. Apparatus in accordance with claim 22, wherein each of an upper lug surface and the lower arm surface supported thereon contains a mating keyway which extends radially to said longitudinal axis of said turbine shaft, and further comprising a key positioned in the mating keyway of each of an upper lug surface and the lower arm surface supported thereon.

* * * * *